US005102037A

United States Patent [19]

Bryan

[11] Patent Number: 5,102,037

[45] Date of Patent: Apr. 7, 1992

[54] STACKABLE PACKAGE CAPABLE OF DIVISION

[76] Inventor: Robert M. Bryan, P.O. Box 35664, Edina, Minn. 55435

[21] Appl. No.: 744,981

[22] Filed: Aug. 14, 1991

[51] Int. Cl.[5] ..... B65D 5/48

[52] U.S. Cl. ..... 229/120.011; 229/120.13; 229/919; 229/DIG. 11

[58] Field of Search ..... 229/120.11, 120.13, 229/915, 919, DIG. 11; 206/602

[56] References Cited

U.S. PATENT DOCUMENTS

| | | | |
|---|---|---|---|
| 2,454,573 | 11/1948 | Scher | 229/919 |
| 2,514,587 | 7/1950 | Nugent | 229/919 |
| 2,684,178 | 7/1954 | Keeler | 206/602 |
| 3,158,312 | 11/1964 | Simkins | 206/602 |
| 4,103,819 | 8/1978 | Muise | 229/919 |
| 4,913,291 | 4/1990 | Schuster | 229/120.11 |
| 4,998,615 | 3/1991 | Bryan | 229/919 |
| 5,039,002 | 8/1991 | Spaner | 229/DIG. 11 |

*Primary Examiner*—Gary E. Elkins

[57] ABSTRACT

A composite tray and stacker structure for packages of a plurality of identical paperboard and/or plastic containers supported in a tray for the purpose of providing compressive load-bearing capability to the package. The composite tray and stacker is composed essentially of a single sheet of stiff material, such as corrugated paperboard. The structure includes a rectangular tray bottom wall having a central transverse reverse fold line and a pair of end walls connected to the bottom wall along fold lines. A pair of top wall spacer elements are foldably connected along the top edges of the end walls and a pair of weight-bearing abutable stacker elements are foldably connected to the spacer elements. A relatively narrow product retainer panel is connected to each of the side edges of each of the end walls and stacker elements along fold lines and fastening tabs are connected along fold lines to each end of the retainer panels. In the assembled package the end walls and spacer elements lie in parallel spaced apart relation to support packages stacked one on another. The tabs of the retainer panels engage the outer surfaces of the bottom tray and top wall. The assembled package encloses a pair of mirror image cells or compartments for product containers and is readily divisible into half packages.

14 Claims, 2 Drawing Sheets

STACKABLE PACKAGE CAPABLE OF DIVISION

BACKGROUND OF THE INVENTION

1. Field of the Invention

This invention relates to a composite tray and stacker for packages of a plurality of identical paperboard and/or plastic containers supported in the tray for the purpose of providing compressive load-bearing capability to the package. The package of this invention is characterized by its capability of being divided into half packages and the elimination of need for shrink wrapping.

In my prior U.S. Pat. No. 4,998,615 and in my copending application Ser. No. 644,962 there are disclosed shrink wrapped packages of a plurality of identical paperboard and/or plastic containers contained in a tray with a composite built-in stacker structure, and characterized by the efficiency and convenience of having the tray and stacker structure formed from a single piece of corrugated sheet material. Both forms of these packages are in widespread use and are emminently performing their intended functions.

In recent years there has been a proliferation of brands and varieties of products within a single brand. Examples are plain cereal, cereal with raisins, cereal with fruit and nuts, etc., and products which come in a variety of flavors. Many smaller stores have difficulty coping with full cases of these products, creating demands for half cases. The same problem exists for some relatively slow moving products.

At the same time there is increasing concern with respect to environmentally safe disposal of plastic shrink wrap. Most smaller stores do not have a sufficient volume of shrink wrap to warrant accumulation for recycling. As a result most of it goes to landfills or is incinerated with unknown effect on ground water and air quality.

The present invention is directed to a stackable package constructed from a single piece of corrugated sheet material, which is readily divided into two halves, and which does not require the use of an outer shrink wrap to maintain the packaged product container within the package. The package of this invention is also adapted to use with heavy products, such as large sizes of liquids like milk, juices, etc., which are more readily handled in half size cartons.

2. The Prior Art

The prior art of record in my aforesaid U.S. Pat. No. 4,998,615 and application Ser. No. 644,962 is incorporated herein by reference.

SUMMARY OF THE INVENTION

The present invention is directed to a package of a plurality of identical paperboard and/or plastic containers contained in a tray with a composite built-in stacker structure. The composite tray and stacker structure includes a rectangular tray bottom wall having a central transverse reverse fold line with a pair of relatively wide rectangular end walls connected along their bottom edges to opposite ends of the tray bottom wall along spaced apart parallel fold lines. The end walls are of a width approximately equal to the height of the containers to be packaged. A pair of rectangular top wall spacer elements are each connected along one edge to the top edge of each of the end walls along a fold line. A pair of rectangular weight-bearing stacker elements are each connected to one of the spacer elements along a fold line opposite from the spacer connection to the end walls. The width of the stacker elements is approximately equal to the width of the end walls. The stacker elements abut in the center of the package.

A relatively narrow product retainer panel is connected to each of the side edges of each of the end walls and stacker elements along fold lines and fastening tabs are connected along fold lines to each end of the retainer panels. In the assembled package the fastening tabs engage the outer surfaces of the bottom tray and top walls.

BRIEF DESCRIPTION OF THE DRAWINGS

The invention is illustrated in the accompanying drawings in which corresponding parts are identified by the same numerals and in which.

DETAILED DESCRIPTION OF THE PREFERRED EMBODIMENT

Figure 1:
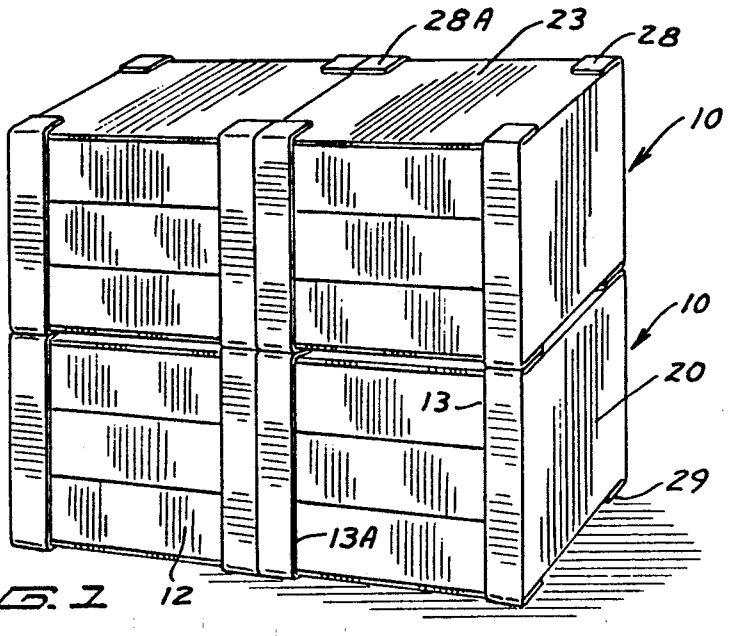
FIG. 1 is a perspective view showing two typical packages according to the present invention stacked one upon the other.

Referring now to the drawings, and particularly to FIG. 1, there is shown a pair of typical divisible packages according to the present invention, indicated generally at 10, stacked one upon the other. The package includes a flat tray portion and an integral stacker structure formed from a single sheet of stiff sheet material. A plurality of identical paperboard and/or plastic product containers 12 are supported within the tray portion of the package. As explained in detail hereinafter, a plurality of relatively narrow product retainer panels 13 and 13A hold the containers within the package, eliminating the necessity for a shrink plastic overwrap.

Although the divisible composite tray and stacker structure according to the present invention is intended for use without shrink wrapping packages, there may be circumstances in which shrink wrapping is desirable though unnecessary. For example, if the packages are to be exposed to a particularly dirty environment, protective shrink wrapping may be used. Even then a stack of unwrapped packages in a palletized load may be shrink wrapped as a unit, without the necessity of wrapping each individual package, to provide the desired protection.

Figure 2:
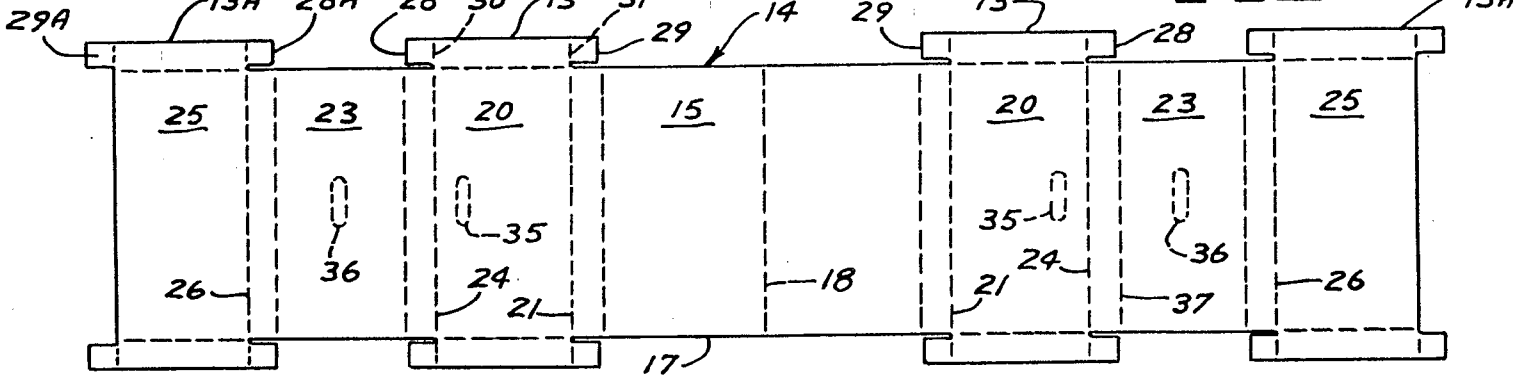
FIG. 2 is a plan view of the sheet material blank from which a composite tray and stacker may be formed, showing optional hand-holds and tear strips which may be used.
Figure 5:
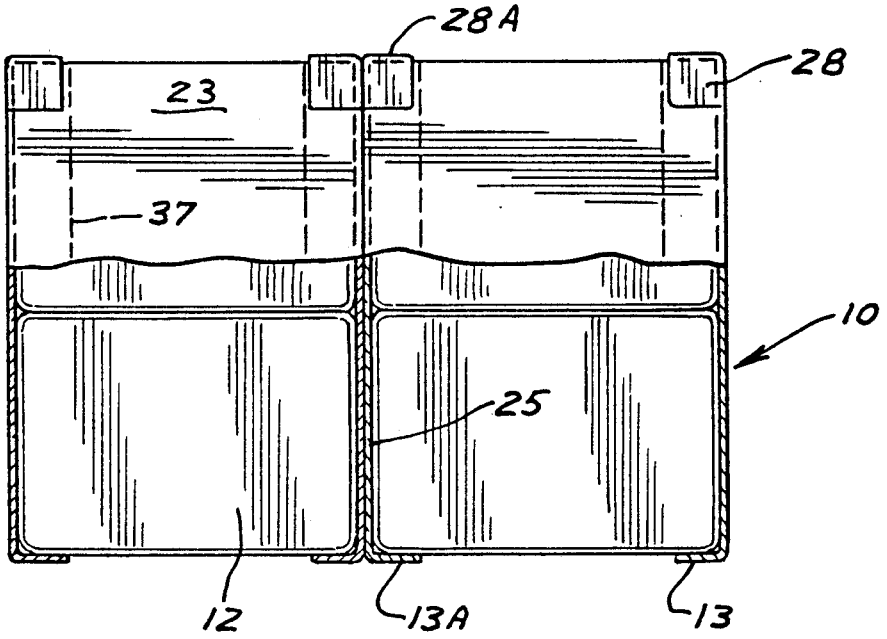
FIG. 5 is a top plan view thereof partly broken away to show underlying structure.
Figure 6:
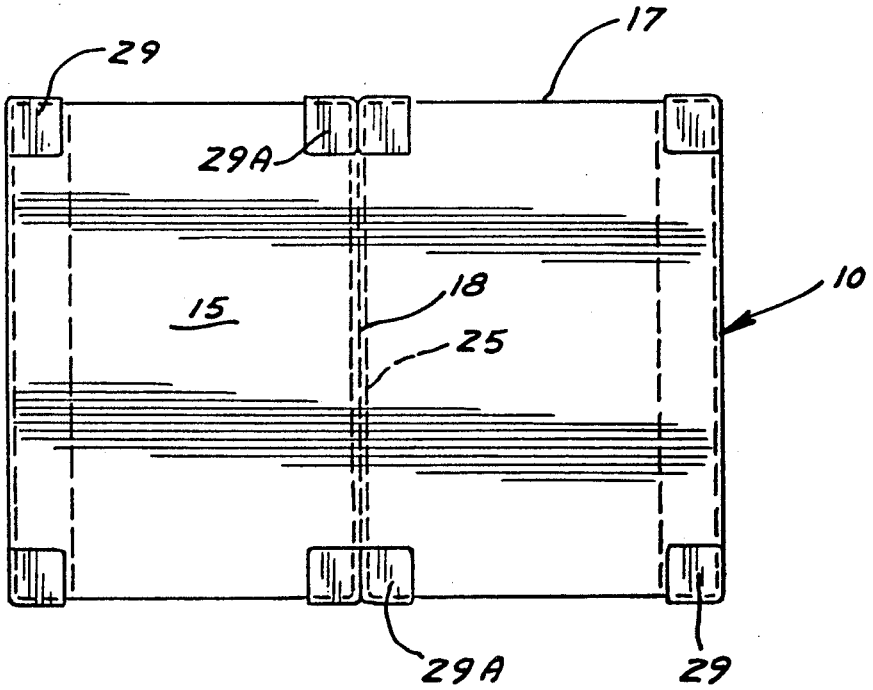
FIG. 6 is a bottom plan view thereof.

Referring to FIG. 2, there is shown a blank 14 from which the divisible composite tray and stacker is assembled. The blank includes a rectangular tray bottom wall section 15 having front and rear edges 17. To facilitate loading, tray bottom wall 15 has central transverse fold line 18. The end wall sections 20 of the blank are connected to the tray bottom wall portion along spaced apart parallel fold lines 21. A pair of top wall spacer elements 23 are each connected along a fold line 24 to the adjacent end wall section 20. A stacker element 25 is connected along a fold line 26 to the next adjacent spacer element 23. The widths of the stacker elements 25 are approximately equal to the widths of the end wall portions 20. The combined widths of the top wall spacer elements 23 are approximately equal to the length of the tray bottom wall. This form of package is adapted to the packaging of containers 12 arrayed on the bottom wall of the tray in an even numbered series of rows.

The illustrated containers 12 are relatively flat rectangular boxes stacked in two rows of three boxes in each half of the package. The containers may be vertically arrayed boxes; or cartons such as used to dispense liquids such as milk or juices; or jugs such as used to dispense milk, distilled water, juices, etc.; or bottles used to dispense cooking and lubricating oils, detergents, etc.; and the like. Large containers may be shipped in packages of only four, or even two, containers per package.

A relatively narrow product retainer panel 13, which extends vertically in the assembled package, is co-extensive with each side edge of both end wall sections 20 and is connected to the end wall by a fold line 27. Fastening tabs 28 and 29 are provided at each end of retainer panel 13, connected thereto along fold lines 30 and 31, respectively. Similarly, a like retainer panel 13A is co-extensive with each side edge of both stacker elements 25 and is connected thereto by a fold line 27A. Fastening tabs 28A and 29A are provided at each end of retainer panel 13A, connected thereto along fold lines 30A and 31A, respectively.

Retainer panels 13 and 13A are each of a width less than one fourth the length of the bottom tray wall 15. Preferably they are only wide enough to securely retain the packaged containers within the assembled package. This leaves a substantial gap or window in each half face of the assembled package through which the packaged product is visible and may be displayed when the package itself is used as a display in lieu of shelving the containers.

In assembling the package, the end walls 20 are folded along fold lines 21 to extend vertically relative to the horizontal tray bottom wall 15. The stacker elements 25 are folded along fold lines 26 to extend at right angles to the top wall spacer elements 23 which are folded along fold lines 24 to extend horizontally at right angles relative to the top edges of the side walls 20. To facilitate insertion of the stacker elements 25 between adjacent rows of containers 12, reverse fold line 18 permits slight humping of the tray bottom wall and separation of the tops of the containers. A narrow bead or strip of glue or other adhesives as are commonly used in the packaging industry is applied to the top edge of one of stacker elements 25 along fold line 27 to secure the stacker elements in face-to-face abutting relation, but permitting later separation to divide the assembled package into halves.

Retainer panels 13 and 13A are folded inwardly along fold lines 27 and 27A, respectively. Fastening tabs 28 and 29 are folded inwardly along fold lines 30 and 31, respectively. Tabs 28 are secured by glue or other adhesive to the outside top surface of top wall spacer elements 23 adjacent to the top outside edges of the assembled package formed at fold lines 24. Tabs 29 are similarly secured to the outside bottom surface of bottom tray 15 along the bottom outside edges of the package formed at fold lines 21.

Fastening tabs 28A and 29A are folded inwardly along fold lines 30A and 31A, respectively. Tabs 28A are secured to the outside top surface of top wall spacer elements 23 adjacent to and on opposite sides of the abuttment between stacker elements 25 at fold lines 26. Tabs 29A are similarly secured to the outside bottom surface of bottom tray 15 adjacent to and on opposite sides of reverse fold line 18.

Figure 3:
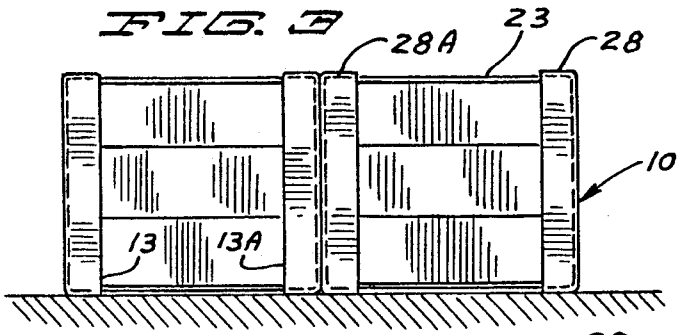
FIG. 3 is a front elevation of an assembled tray and stacker.
Figure 4:
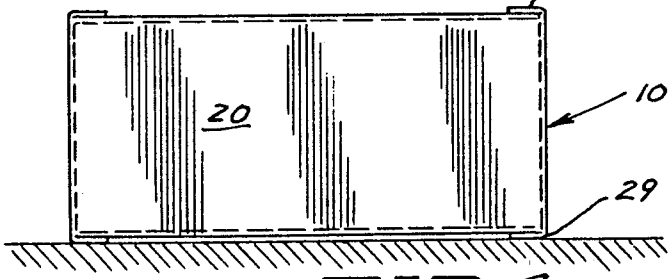
FIG. 4 is an end elevation thereof.

In so assembling the package, the weight-bearing stacker elements 25 extend vertically downwardly to the tray bottom wall, as shown in FIG. 3. The combination of the abutting stacker elements 25 along with side walls 20, both strengthened by retainer panels 13A and 13, respectively, permits stacking of packages on top of the package top wall formed by spacer elements 23. The packaged containers are securely held in the mirror image cells defined by the bottom tray 15, top wall spacers 23, end walls 20, stacker elements 25 and retainer panels 13 and 13A.

Upon arrival at the distribution point for the packaged containers, if customer requirements so demand, the packages are easily divisible into halves. The abutting stacker elements 25 are readily separated by tearing apart the narrow glue line joining them at their top edge. A cut may be made along the reverse fold line 18, or preferably the reverse fold line is perforated to permit easy separation of the bottom tray 15. In this manner retailer demands for half cartons of products can be satisfied while maintaining the integrity of the packages until they reach their final destination.

The relative sizes and proportions of the various package components: bottom tray, end walls, top walls, stackers and retainer panels, depend upon the products to be packaged and the number of units to be enclosed in a single package. Where the products are heavy hand-holds 35 may optionally be provided in the end walls 20, either by whole or partial die cuts or perforations, to facilitate handling of the packages. Similarly, hand-holds 36 may optionally be provided in the center of the top walls 23 to facilitate carrying of relatively bulky and heavy products as gallon sizes of milk or juices, or the like. These products may be purchased by the ultimate consumer in half cartons, and taken home without the necessity of opening the package. In some instances a twin-pack may be desirable. In this case the hand-holds are located closely spaced apart on opposite sides of the seam formed by the abutting spacer elements.

Where the packaged product may be sold to the consumer without removal from the package and shelving, transverse perforations 37 are provided in the top wall spacer elements 23 spaced inwardly from fold lines 24 and 26 by a distance about equal to the width of fastening tabs 28. When the package reaches the sales floor the panel between perforations 37 can readily be removed by tearing the perforations, converting the package into a display from which the product containers are easily removed by the purchaser.

The blank 14 is composed essentially of stiff sheet material, such as corrugated cardboard as is commonly used in the packaging industry. Ordinarily, where the packages are intended to be stored with the trays disposed horizontally and stacked one on top of the other, the corrugations extend vertically for maximum strength. Blank 14 is die cut from corrugated stock with minimum waste. That minimum waste is recyclable.

It is apparent that many modifications and variations of this invention as hereinbefore set forth may be made without departing from the spirit and scope thereof. The specific embodiments described are given by way of example only and the invention is limited only by the terms of the appended claims.

I claim:

1. A composite tray and stacker structure for a divisible stackable package of a plurality of identical containers, said structure comprising:

(A) a rectangular tray bottom wall;

(B) a central transverse reverse fold line across the tray bottom wall;

(C) a pair of rectangular end walls connected along their bottom edges to opposite ends of said bottom wall along spaced apart parallel fold lines, said end walls being of a width approximately equal to the height of the containers to be packaged;

(D) a relatively narrow product retainer panel coextensive with and connected to each side edge of both of said end walls along a fold line at the side edges of the end walls, said retainer panels being of a width less than one fourth the length of said bottom tray wall and having a fastening tab at each end thereof connected thereto along parallel widely spaced apart fold lines;

(E) a pair of rectangular spacer elements comprising the top wall of said package, each connected along one edge to one of said end walls along a fold line at the top edge of each of the end walls; the width of said spacer elements being equal to about one half of the length of the bottom tray;

(F) a pair of rectangular weight-bearing stacker elements each connected to one of said spacer elements along a fold line along the opposite edge thereof, the width of said stacker elements being approximately equal to the width of the end walls; and (G) a relatively narrow product retainer panel coextensive with and connected to each side edge of both of said stacker elements along a fold line at the side edges of the stacker elements, said retainer panels being of a width less than one fourth the length of said bottom tray wall and having a fastening tab at each end thereof connected thereto along parallel widely spaced apart fold lines.

2. A composite tray and stacker structure according to claim 1 wherein said reverse fold line is perforated.

3. A composite tray and stacker structure according to claim 1 wherein a die cut or perforated hand-hold is provided in each of said top wall spacer elements.

4. A composite tray and stacker structure according to claim 1 wherein a die cut or perforated hand-hold is provided in each of said end walls midway between the retainer panels connected thereto and spaced from the fold line between the end walls and top wall spacer elements.

5. A composite tray and stacker structure according to claim 1 wherein a pair of transverse parallel spaced apart lines of perforations are provided in each of said top wall spacer elements extending between the edges of the top wall elements and spaced inwardly from the fold lines connecting the top wall elements to the end walls and stacker elements.

6. A composite tray and stacker structure according to claim 5 wherein:

(A) said end walls, top wall spacer elements and stacker elements are folded inwardly to bring the stacker elements into face-to-face abutment; and (B) said stacker elements, in face-to-face abutment, are connected in an adhesive seam immediately adjacent to the fold lines between the stacker elements and top wall spacer elements.

7. A composite tray and stacker structure according to claim 6 wherein:

(A) the retainer panels and fastening tabs are turned inwardly;

(B) the fastening tabs at one end of each of the retainer panels connected to the end walls are adhesively secured to the outside surface of the top wall spacer elements adjacent to the edges formed by the fold lines between the end walls and top wall elements;

(C) the fastening tabs at the opposite ends of said retainer panels are adhesively secured to the outside surface of the bottom tray adjacent to the edges formed by the fold lines between the end walls and bottom tray;

(D) the fastening tabs at one end of each of the retainer panels connected to the stacker elements are adhesively secured to the outside surface of the top wall spacer elements adjacent to the seam formed by abutting stacker elements; and (E) the fastening tabs at the opposite ends of said retainer panels are adhesively secured to the outside surface of the bottom tray adjacent to the reverse fold line.

8. A composite tray and stacker structure according to claim 1 wherein said structure is comprised of corrugated board, the corrugations of which extend parallel to the direction of the bottom wall side edges, whereby the package has maximum load-bearing capability when stacked with its bottom wall horizontal.

9. In combination:

(A) a composite tray and stacker structure according to claim 7; and (B) a plurality of identical product containers supported on the bottom wall of the tray between the side edges and end walls thereof, the stacker elements separating said containers into an equal number of containers.

10. A combination according to claim 9 wherein said reverse fold line is perforated.

11. A combination according to claim 9 wherein a die cut or perforated hand-hold is provided in each of said top wall spacer elements.

12. A combination according to claim 9 wherein a die cut or perforated hand-hold is provided in each of said end walls midway between the retainer panels connected thereto and spaced from the fold line between the end walls and top wall spacer elements.

13. A combination according to claim 9 wherein a pair of transverse parallel spaced apart lines of perforations are provided in each of said top wall spacer elements extending between the edges of the top wall elements and spaced inwardly from the fold lines connecting the top wall elements to the end walls and stacker elements.

14. A combination according to claim 9 wherein said structure is comprised of corrugated board, the corrugations of which extend parallel to the direction of the bottom wall side edges, whereby the package has maximum load-bearing capability when stacked with its bottom wall horizontal.

* * * * *